US008948656B2

(12) United States Patent
Nakano

(10) Patent No.: US 8,948,656 B2
(45) Date of Patent: Feb. 3, 2015

(54) IMAGE FORMING APPARATUS

(71) Applicant: Hiroshi Nakano, Nagoya (JP)

(72) Inventor: Hiroshi Nakano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 129 days.

(21) Appl. No.: 13/626,157

(22) Filed: Sep. 25, 2012

(65) Prior Publication Data

US 2013/0121722 A1 May 16, 2013

(30) Foreign Application Priority Data

Nov. 14, 2011 (JP) ..... 2011-248960

(51) Int. Cl.
*G03G 15/00* (2006.01)
*G03G 21/16* (2006.01)

(52) U.S. Cl.
CPC ..... *G03G 21/1628* (2013.01)
USPC ..... 399/125

(58) Field of Classification Search
USPC ..... 399/110, 113, 125
See application file for complete search history.

(56) References Cited

U.S. PATENT DOCUMENTS

| | | | |
|---|---|---|---|
| 7,937,021 | B2 | 5/2011 | Sezaki et al. |
| 2004/0101328 | A1 | 5/2004 | Kimura et al. |
| 2005/0281584 | A1 | 12/2005 | Kimura et al. |
| 2006/0153589 | A1 | 7/2006 | Sato et al. |
| 2007/0036584 | A1 | 2/2007 | Kimura et al. |
| 2007/0280728 | A1 | 12/2007 | Sezaki et al. |
| 2010/0247198 | A1 | 9/2010 | Saiki et al. |
| 2011/0217070 | A1 | 9/2011 | Watanabe |

FOREIGN PATENT DOCUMENTS

| | | |
|---|---|---|
| JP | 2003-241618 A | 8/2003 |
| JP | 2004-094151 | 3/2004 |
| JP | 2006-139068 | 6/2006 |
| JP | 2007-322774 | 12/2007 |
| JP | 2008-046403 | 2/2008 |
| JP | 2009-211020 | 9/2009 |
| JP | 2010-231087 | 10/2010 |
| JP | 2011-059182 | 3/2011 |
| JP | 2011-180418 A | 9/2011 |

OTHER PUBLICATIONS

Co Pending U.S. Appl. No. 13/832,811, filed Mar. 15, 2013.
Non-Final Office Action received in corresponding U.S. Appl. No. 13/832,811 mailed May 19, 2014.

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming apparatus includes a housing defining a sheet convey path through which a sheet is conveyed, a transfer belt disposed in the sheet convey path within the housing, a plurality of photosensitive members disposed opposite to the transfer surface from below in the housing, and a plurality of developing units disposed in the housing such that each of the developing units corresponds to one of the photosensitive members. The housing includes a first body configured to accommodate the developing units detachably and a second body disposed above the first body and configured to accommodate the transfer belt and the photosensitive members. The second body is configured to pivot around a pivot axis located on a first end of the first body and separate upward from the first body such that the developing units are exposed from the first body.

13 Claims, 12 Drawing Sheets

IMAGE FORMING APPARATUS

CROSS REFERENCE TO RELATED APPLICATION

This application claims priority from Japanese Patent Application No. 2011-248960, filed on Nov. 14, 2011, the content of which is incorporated herein by reference in its entirety.

TECHNICAL FIELD

Aspects of the disclosure relate to an image forming apparatus.

BACKGROUND

A known image forming apparatus may include a housing defining a sheet conveyance path in which a sheet is conveyed, and a transfer belt disposed in the sheet conveyance path within the housing. The transfer belt circulates and has a transfer surface. The transfer surface is a flat surface which extends in a width direction of a sheet to be conveyed and is inclined slightly with respect to a horizontal direction.

The image forming apparatus includes four photosensitive members and four respective developing units. The photosensitive members are disposed facing the transfer surface from below in the housing and arranged in a longitudinal direction of the transfer surface.

In the image forming apparatus, each developing unit supplies a developer onto an electrostatic latent image formed on a corresponding photosensitive member to form a developer image. The developer image is transferred from each photosensitive member to the transfer surface, and then transferred onto a sheet being conveyed in the sheet conveyance path. In this way, the image forming apparatus is configured to form an image on a sheet.

In the image forming apparatus, even if each developing unit could be replaceable, it is liable to interfere with the transfer belt, the photosensitive members and other elements disposed in the vicinity of each developing unit, and it seems like replacement of each developing unit is not easy. To improve maintenance, it is required that developing devices are replaced easily.

SUMMARY

Aspects of the disclosure may provide an image forming apparatus facilitating replacement of developing units.

According to one aspect of the disclosure, an image forming apparatus includes a housing defining a sheet convey path through which a sheet is conveyed, a transfer belt disposed in the sheet convey path within the housing, a plurality of photosensitive members disposed opposite to the transfer surface from below in the housing, and a plurality of developing units disposed in the housing such that each of the plurality of developing units corresponds to one of the plurality of photosensitive members. The transfer belt is configured to circulate and having a transfer surface which is a flat surface extending in a width direction of the sheet to be conveyed. The plurality of photosensitive members are arranged in parallel relative to each other in a longitudinal direction of the transfer surface parallel to the transfer surface and perpendicular to the width direction. Each of the plurality of developing units is configured to supply a developer to an electrostatic latent image formed on a surface of a corresponding one of the plurality of photosensitive members and develop the electrostatic latent image into a developer image. The housing includes a first body configured to accommodate the plurality of developing units detachably and a second body disposed above the first body and configured to accommodate the transfer belt and the plurality of photosensitive members. The second body is configured to pivot around a pivot axis located on a first end of the first body and separate upward from the first body such that the plurality of developing units are exposed from the first body.

BRIEF DESCRIPTION OF THE DRAWINGS

Illustrative aspects of the disclosure will be described in detail with reference to the following figures in which like elements are labeled with like numbers and in which.

DETAILED DESCRIPTION

A first illustrative embodiment of the disclosure will be described in detail with reference to the accompanying drawings.

Figure 1:
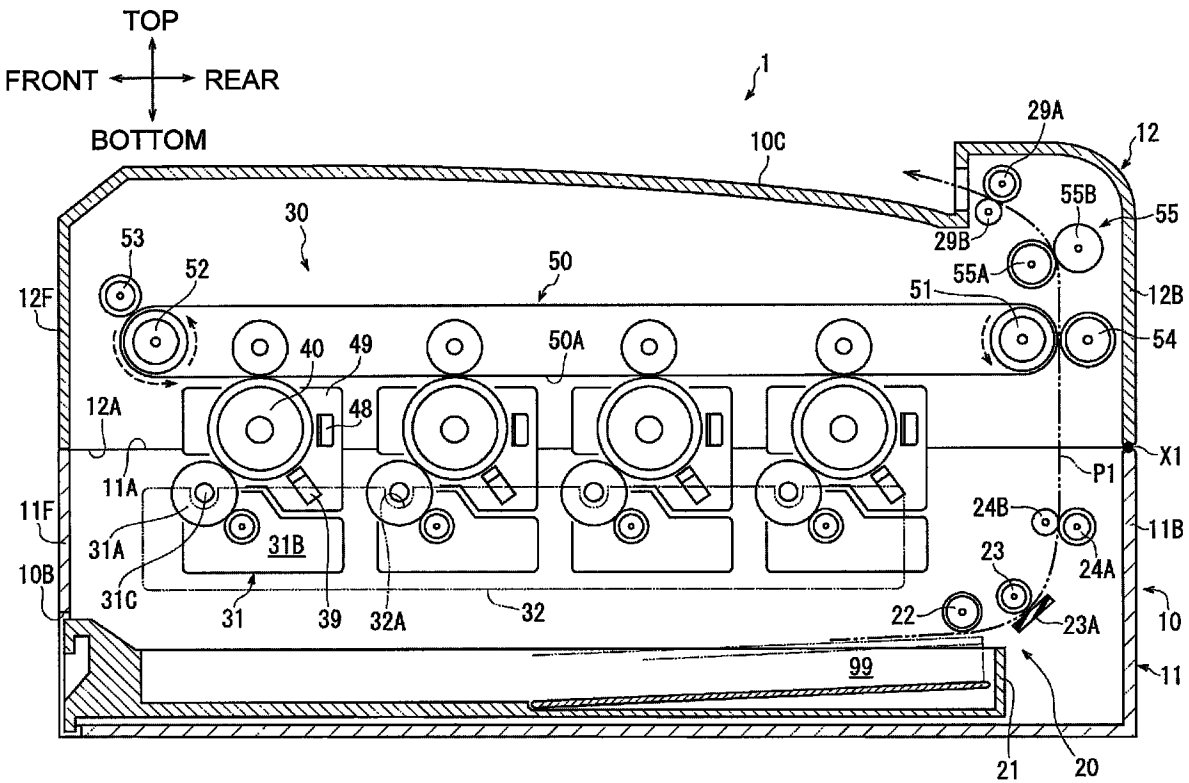
FIG. 1 is a cross sectional view schematically illustrating an image forming apparatus according to a first illustrative embodiment of the disclosure.

As shown in FIG. 1, an image forming apparatus 1 of the first illustrative embodiment is a color laser printer producing a color image on a sheet 99 such as a plain sheet of paper and a transparency. In FIG. 1, the left side of the drawing sheet is referred to as a front side of the image forming apparatus 1. For ease of discussion, in the following description, the top or upper side, the bottom or lower side, the front or front side, and the rear or rear side of the image forming apparatus 1 will be identified as indicated by the arrows in FIG. 1. The left or left side and the right or right side of the image forming apparatus 1 will be referenced as viewed from a vantage point in front of the image forming apparatus. With regard to various individual objects of the image forming apparatus 1, sides of the individual objects will be similarly identified based on the arranged/attached position of the object on/in the image forming apparatus 1 shown in FIG. 1. The directions, front, rear, left, right, top, and bottom, shown in each drawing are referenced based on the directions shown in FIG. 1. In the following, components of the image forming apparatus 1 will be described based on FIG. 1.

A general structure of the image forming apparatus 1 will be described.

As shown in FIG. 1, the image forming apparatus 1 includes a housing 10 having a first body 11 and a second body 12 disposed on and above the first body 11.

The first body 11 is shaped like a box of which upper side is substantially wholly open to form a first opening 11A. A lower portion of a front end portion 11F of the first body 11 has a sheet cassette opening 10B opening in the front-rear direction.

The second body 12 is shaped like a box of which lower side is substantially wholly open to form a second opening 12A. An upper surface of the second body 12 contains an ejection tray 10C inclined and recessed rearward.

Figure 2:
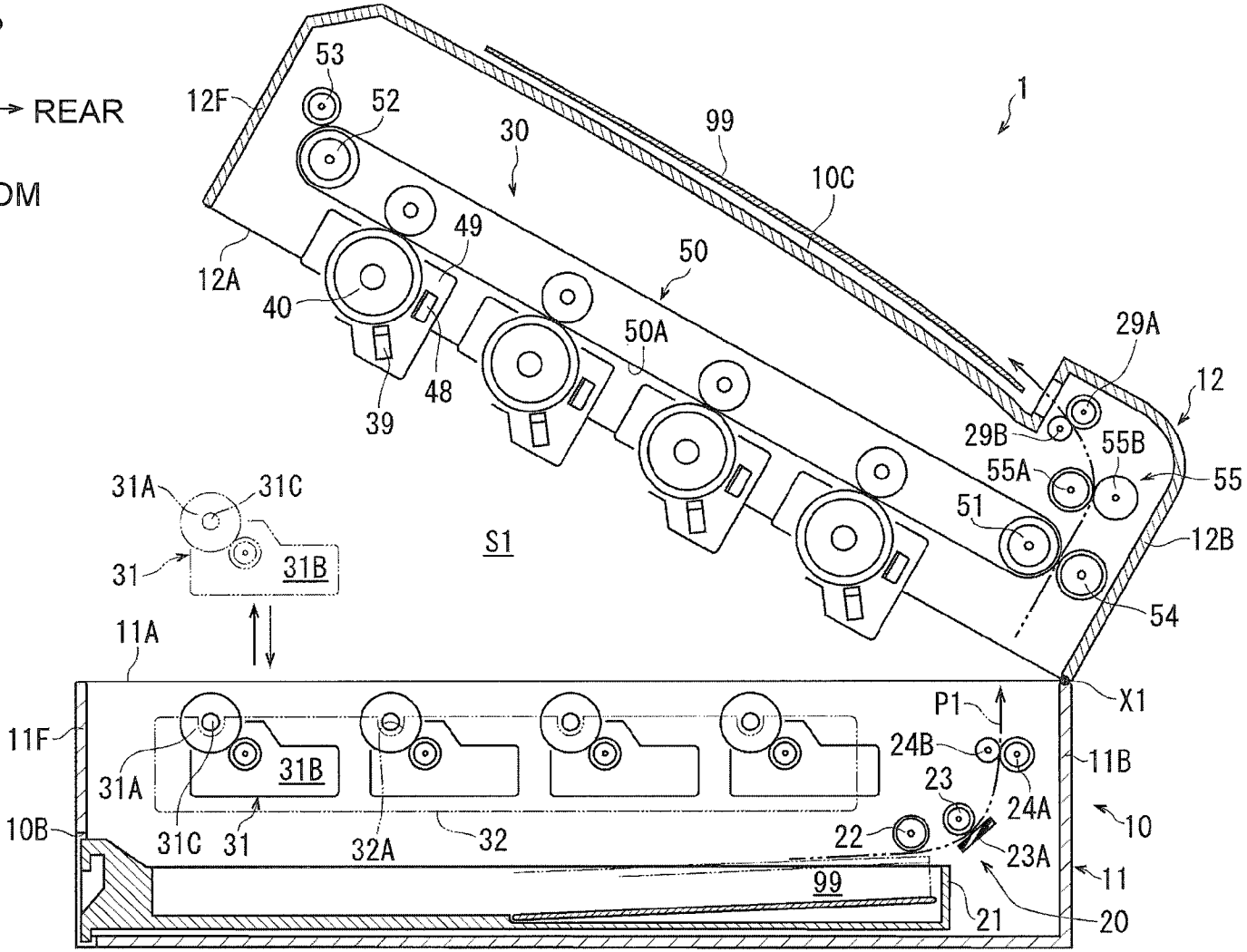
FIG. 2 is a cross sectional view schematically illustrating the image forming apparatus according to the first illustrative embodiment of the disclosure in which a second body pivots with respect to a first body.

As shown in FIGS. 1 and 2, the second body 12 is supported by the first body 11 such that the second body 12 is configured to pivot around a pivot axis X1 located on a side closer to a rear end portion 11B of the first body 11. The second body 12 is pivotally coupled to the first body 11 via a hinge, which is not shown. The pivot axis X1 is located between an upper end of the rear end portion 11B of the first body 11 and a lower end of a rear end portion 12B of the second body 12. The rear end portion 11B of the first body 11 is an example of a first end of a first body on which a pivot axis is located.

As shown in FIG. 1, the second body 12 covers the first body 11 from above when the second body 12 does not pivot around the pivot axis X1. In this state, the first opening 11A and the second opening 12A overlap each other vertically, defining an internal space of the housing 10. The housing 10 includes a frame member, not shown, therein.

As shown in FIG. 2, the second body 12 pivots around the pivot axis X1 such that the front end portion 12F is separated upward from the first body 11. Thus, the second body 12 is inclined upward with respect to the first body 11, and the opening 11A is released. As a result, process cartridges 31 are exposed from the first opening 11A of the first body 11.

The position of the second body 12 pivoted shown in FIG. 2 is one example. Although not shown, the second body 12 may be pivotable further upward from the position shown in FIG. 2. In this case, the second body 12 can release the first opening 11A further greatly than that shown in FIG. 2.

As shown in FIG. 1, a sheet cassette 21 is detachably attached to the lower portion of the first body 11. The sheet cassette 21 is shaped like a box such that an upper side thereof is released to receive a stack of sheets 99 therein. The sheet cassette 21 is mounted in the housing 10 by insertion via the sheet cassette opening 10B from the front end portion 11F of the first body 11 substantially horizontally, and removed from the housing 10 by reversing the insertion step.

The housing 10 defines therein a sheet conveyance path P1 through which a sheet 99 is conveyed from the sheet cassette 21. The sheet conveyance path P1 extends from a rear end portion of the sheet cassette 11 toward the rear end portion 11B of the first body 11, goes upward along the rear end portion 11B of the first body 11 and the rear end portion 12B of the second body 12, goes frontward at an upper portion of the rear end portion 12B of the second body 12, and reaches the ejection tray 10C. In this embodiment, a width of the sheet 99 to be conveyed extends in the left-right direction.

In the housing 10, a sheet supply portion 20, an image forming portion 30, ejection rollers 29A, 29B are disposed above the sheet cassette 21.

The sheet supply portion 20 is disposed at the rear of the sheet cassette 21. The sheet supply portion 20 is assembled to the frame member (not shown) disposed in the first body 11. The sheet supply portion 20 is configured to convey a sheet 99 separated from the stacked sheets 99 stored in the sheet cassette 21 by a pickup roller 22, a separation roller 23 and a separation pad 23A, to the sheet conveyance path P1. A pair of the conveying rollers 24A, 24B are disposed in a lower portion of a straight portion of the sheet convey path P1 and configured to convey the sheet 99 upward.

The image forming portion 30 is of an intermediate transfer type, and includes a transfer belt 50, a plurality of, e.g., four, photosensitive drums 40 as an example of a photosensitive member, a plurality of, e.g., four, exposure LEDs 39, a plurality of, e.g., four, process cartridges 31 as an example of a developing device, a secondary transfer roller 54, and a fixing unit 55.

The transfer belt 50 is accommodated in the second body 12. The transfer belt 50 is an endless belt looped around a drive roller 51 and a driven roller 52. The drive roller 51 and the driven roller 52 are supported by a frame member (not shown) disposed in the second body 12. Upon receipt of a drive force from a drive source (not shown), the drive roller 51 is configured to rotate around a shaft extending in the left-right direction on a side closer to the rear end portion 12B of the second body 12. The driven roller 52 is configured to be rotated around a shaft parallel to the drive roller 51 at the front end portion 12F of the second body 12. A cleaning roller 53 is disposed diagonally to the front above the driven roller 52 such that the cleaning roller 53 and the driven roller 52 sandwich the transfer belt 50.

The rotation directions of the drive roller 51, the driven roller 52 and the transfer belt 50 are counterclockwise direction in FIG. 1. The transfer belt 50 extends between the drive roller 51 and the driven roller 52 in the left-right direction and the front-rear direction, and a surface of the transfer belt 50 facing downward is referred to as a transfer surface 50A. As shown in FIG. 2, when the second body 12 pivots around the pivot axis X1, the transfer belt 50, the drive roller 51 and the driven roller 52 move integrally with the second body 12.

"Moving integrally" includes not only a case where the transfer belt 50, the drive roller 51 and the driven roller 52 are simply assembled to the second body 12 but also a case where, during pivoting of the second body 12, the transfer belt 50, the drive roller 51 and the driven roller 52 move integrally with the second body 12 while moving relative to the second body 12. In this embodiment, as shown in FIG. 2, the transfer belt 50, the drive roller 51 and the driven roller 52 are assembled such that they are not relatively moved to each other during pivoting of the second body 12.

As shown in FIG. 1, four photosensitive drums 40, four exposure LEDs 39, and four process cartridges 31 correspond to four colors of black, yellow, magenta and cyan. Toner is an example of a developer.

Each of the photosensitive drums 40 is a cylinder extending in the left-right direction and is accommodated in the second body 12. Each of the photosensitive drums 40 is supported by a corresponding one of support members 49 assembled to the frame member, not shown, disposed in the second body 12. Each of the photosensitive drums 40 is disposed facing the transfer surface 50A from below. Each of the support members 49 includes a charger 48 assembled thereto. Each charger 48 is disposed facing a corresponding one of the photosensitive drums 40 from rear.

The photosensitive drums 40 and the support members 49 are arranged in the front-rear direction along the transfer surface 50A. The front-rear direction in which the photosensitive drums 40 are arranged is an example of a longitudinal direction of the transfer surface parallel to the transfer surface and perpendicular to the width direction. A part of a lower portion of each photosensitive drum 40 and each support member 49 protrudes toward the first body 11.

Each exposure LED 39 is assembled to a corresponding support member 49 such that the exposure LED 39 is disposed diagonally to the rear below the photosensitive drum 40. Each exposure LED 39 includes a plurality of LED elements arranged in a line extending in the left-right direction and facing the photosensitive drum 40. Each exposure LED 39 is configured to expose linear light having exposure patterns based on image data to a surface of the photosensitive drum 40.

As shown in FIG. 2, when the second body 12 pivots around the pivot axis X1, the photosensitive drums 40, the support members 49, the chargers 48, and the exposure LEDs 39 move integrally with the second body 12 as with the transfer belt 50, the drive roller 51 and the driven roller 52. "Moving integrally" here means the same meaning described regarding the transfer belt 50, the drive roller 51 and the driven roller 52.

As shown in FIG. 1, the process cartridges 31 are accommodated in the first body 11. The process cartridges 31 are disposed below the photosensitive drums 40 and the support members 49 and arranged along the transfer surface 50A in the front-rear direction. Each process cartridge 31 is shaped like a rectangle box elongated in the left-right direction, and includes inside a developing roller 31A and a toner container 31B as an example of a developer container. The developing roller 31A is disposed diagonally to the front below a corresponding photosensitive drum 40 and contacts a surface of the photosensitive drum 40.

Toner stored in the toner container 31B is consumed every time the image formation is carried out, and finally becomes empty. Thus, the toner container 31B needs replacing regularly. The developing roller 31A is prone to be worn because it rotates in contact with the photosensitive drum 40 every time the image formation is carried out. The developing roller 31A may be worn very quickly especially for high-speed image formation. Thus, the developing roller 31A also needs replacing regularly to maintain image formation quality. On the contrary, the exposure LEDs 39 do not deteriorate quickly because they do not contact the respective photosensitive drums 40, and emit light at low power. Thus, lifespans of the exposure LEDs 39 are longer than those of the process cartridges 31.

As shown in FIG. 2, the process cartridges 31 are detachably attachable relative to the first body 11. Specifically, the first body 11 includes a process cartridge support member 32 therein. Although schematically shown, the process cartridge support member 32 is comprised of a pair of left and right plates facing each other to sandwich the process cartridges 31 therebetween. The process cartridge support member 32 is assembled to the frame member, not shown, disposed in the first body 11. The process cartridge support member 32 is formed with four positioning recessed portions 32A cut downward from an upper end of the process cartridge support member 32. The intervals at which the positioning recessed portions 32A are spaced apart from each other in the front-rear direction are equal to the intervals at which the process cartridges 31 are arranged in the front-rear direction. Each process cartridge 31 is attached to or removed from the first body 11 by vertically inserting or removing a shaft 31C of each developing cartridge 31A into or from a corresponding one of the positioning recessed portions 32A.

As shown in FIG. 1, the secondary transfer roller 54 is disposed facing the drive roller 51 from the rear side such that the secondary transfer roller 54 and the drive roller 51 sandwich the transfer belt 50 therebetween. The secondary transfer roller 54 is rotatably supported by the frame member, not shown, disposed in the second body 12.

The fixing unit 55 is disposed above the secondary transfer roller 54 in a portion of the sheet convey path P1 extending substantially vertically. The fixing unit 55 includes a heat roller 55A and a pressure roller 55B facing each other via the sheet convey path P1.

The ejection rollers 29A, 29B are disposed at a portion of the sheet convey path P1 where the sheet conveyance direction is changed to the front. The ejection roller 29A is opposite to the ejection roller 29B with the sheet convey path P1 therebetween, and the ejection rollers 29A, 29B face toward the ejection tray 10C. The ejection rollers 29A, 29B are rotatably supported by the frame member, not shown, disposed in the second body 12.

The following will describe an image formation operation in the image forming apparatus 1.

In the image forming apparatus 1 structured above, the sheet supply portion 20, the image forming portion 30 and the ejection rollers 29A, 29B are interlocked to from an image on a sheet 99 based on an instruction from a controller, not shown.

When the image forming apparatus 1 starts the image formation, the sheet supply portion 20 conveys a sheet 99 singly separated from sheets 99 stored in the sheet cassette 21 along the sheet convey path P1.

In the image formation portion 30, surfaces of the photosensitive drums 40 are uniformly and positively charged by corresponding chargers 48 upon rotation, and exposed to linear light emitted from corresponding exposure LEDs 39. Thus, the exposure LEDs 39 form electrostatic latent images on the respective surfaces of the photosensitive drums 40 based on the image to be formed on a sheet 99.

The electrostatic latent images on the respective surfaces of the photosensitive drums 40 are developed into four toner images with toner of four colors supplied from the toner containers 31B by the developing rollers 31A of the process cartridges 31. The toner images are transferred onto the transfer surface 50A acted upon by a negative voltage applied, while the photosensitive drums 40 rotate in contact with the transfer surface 50A.

The toner images on the transfer surface 50A are successively transferred onto a surface of a sheet 99 conveyed upward in the sheet convey path P1 while being nipped by the secondary transfer roller 54 and a portion of the transfer belt 50 looped around the drive roller 51.

The fixing unit 55 applies heat and pressure to the sheet 99, on which the toner images have been transferred, by the heat roller 55A and the pressure roller 55B, to fix the toner images onto the sheet 99. Then, the sheet 99 is conveyed toward the front by the ejection rollers 29A, 29B, and ejected to the ejection tray 10C. In this manner, the image forming apparatus 1 finishes the image formation on the sheet 99.

The following will describe replacement of a process cartridge 31.

In the image forming apparatus 1, the process cartridges 31 can be replaced as follows. By raising the front end portion 12F of the second body 12 shown in FIG. 1, the second body 12 pivots around the pivot axis X1 as shown in FIG. 2. Then, the second body 12 is spaced upward apart from and inclined with respect to the first body 11, and the first opening 11A is released. The transfer belt 50, the drive roller 51, the driven roller 52, the photosensitive drums 40, the support members 49, the chargers 48, the exposure LEDs 39 move integrally with the second body 12, and are spaced upward apart from the first opening 11A. As a result, the process cartridges 31 are exposed from the first body 11 via the first opening 11A. In addition, a space S1 is produced above the process cartridges 31.

A process cartridge 31 is pulled upward. At this time, the shaft 31C of the developing roller 31A is released from the positioning recessed portion 32A, and the process cartridge 31 moves in the space S1 via the first opening 11A. In this manner, each process cartridge 31 can be removed from the first body 11.

By reversing the above removal procedure, a new process cartridge 31 can be attached to the first body 11. In the image forming apparatus 1, the process cartridges 31 can be replaced in this manner.

The process cartridges 31 shown in FIG. 2 are removable along arrowed vertical directions. For example, the process cartridges 31 may be movable diagonally upward to the front. In a structure to move the process cartridges 31 diagonally upward, the process cartridges 31 can be moved without the need to open the second body 12 to a greater angle, such as 90 degrees.

In the image forming apparatus 1 of the first embodiment, the second body 12 pivots upward with respect to the first body 11, such that the process cartridges 31 are exposed from the first body 11 and the space S1 is produced above the process cartridges 31. Thus, the process cartridges 31 can be easily removed from the first body 11 via the space S1. The transfer belt 50 and the photosensitive drums 40 accommodated in the second body 12 move integrally with the pivoting second body 12, and are spaced upward apart from the process cartridges 31. Thus, the transfer belt 50 and the photosensitive drums 40 do not interfere with the attachment or removal of the process cartridges 31.

Thus, in the image forming apparatus 1 of the first embodiment, four process cartridges 31 can be easily replaced.

In the image forming apparatus 1, the developing roller 31A, which is prone to be worn out for the high-speed image formation, is required for regular replacement to maintain the image formation quality. In this point, according to the image forming apparatus 1, each process cartridge 31 includes the toner container 31B and the developing roller 31A. When toner is replenished into the toner container 31B, the developing roller 31A can be replaced with a new one. Thus, the image formation quality can be easily maintained.

In this image forming apparatus 1, the lifespans of the exposure LEDs 39 are longer than those of the process cartridges 31. According to the image forming apparatus 1, the exposure LEDs 39 are irrelevant to the attachment and removal of the process cartridges 31 because they are disposed in the support members 49 of the second body 12. Thus, the exposure LEDs 39 can be used for a longer time with a reduced cost, compared with a structure where the exposure LEDs 39 may be disposed in the first body 11 and replaced together with the process cartridges 31.

In this image forming apparatus 1, the pivot axis X1 extends in the left-right direction which is a width direction of a sheet 99 to be conveyed. The sheet 99 having an image formed thereon is conveyed from the rear end portion 11B (as an example of a first end) of the first body 11 to the front end portion 11F (as an example of a second end) of the first body 11, in other words, from rear to front. The sheet 99 is ejected to the ejection tray 10C recessed such that it is inclined downward to the rear on the upper surface of the second body 12. With this structure, as shown in FIG. 2, even when the second body 12 pivots upward with the sheet 99 ejected to the ejection tray 10C, the sheet 99 will not fall.

A second embodiment will be described with reference to FIG. 3.

Figure 3:
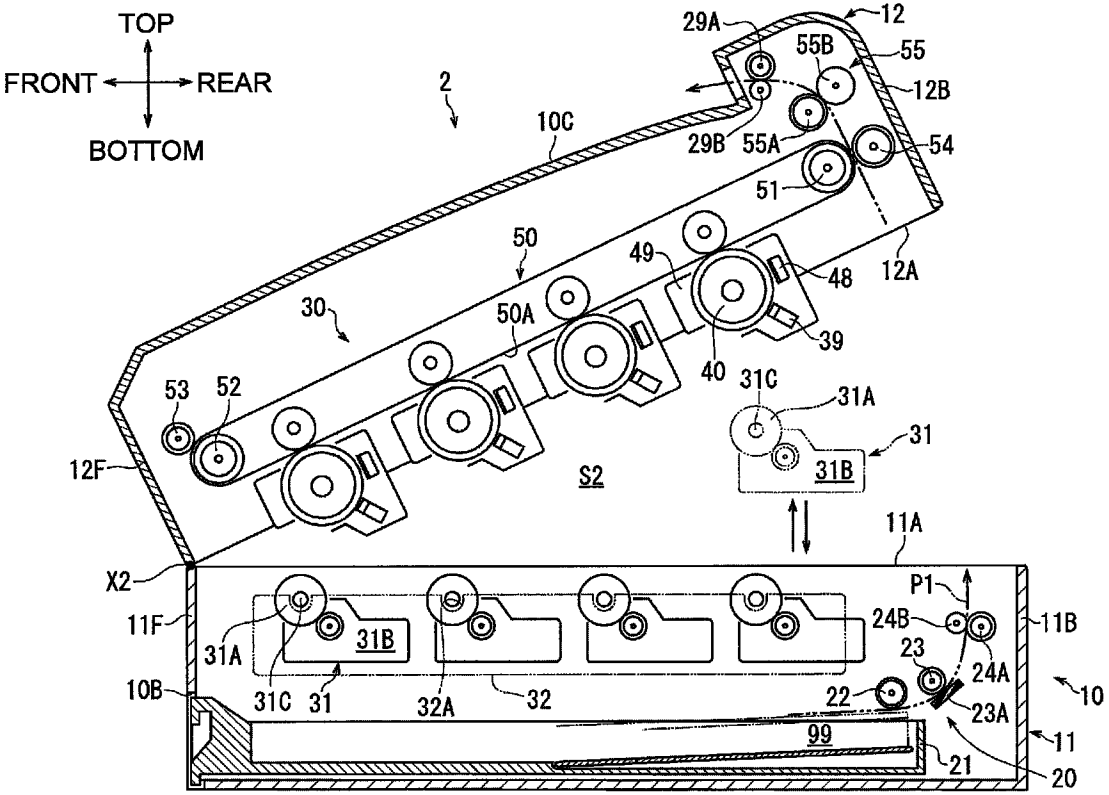
FIG. 3 is a cross sectional view schematically illustrating an image forming apparatus according to a second illustrative embodiment of the disclosure in which a second body pivots with respect to a first illustrative embodiment.

As shown in FIG. 3, an image forming apparatus 2 of the second embodiment uses a pivot axis X2, whose position is changed from the pivot axis X1 of the image forming apparatus 1 of the first embodiment. Other elements of the image forming apparatus 2 of the second embodiment are similar to or identical with those of the image forming apparatus 1 of the first embodiment. Thus, it is noted that the elements are designated by similar numerals, and thus the description thereof can be omitted for the sake of brevity.

In the image forming apparatus 2 of the second embodiment, the second body 12 is supported by the first body 11 such that the second body 12 pivots around the pivot axis X2 located on a side closer to the front end portion 11F of the first body 11 than the rear end portion 11B. The pivot axis X2 is located between the upper end of the front end portion 11F of the first body 11 and the lower end of the front end portion 12F of the second body 12 and extends in the left-right direction.

When the second body 12 is disposed in a horizontal state where it does not pivot around the pivot axis X2, although it is not shown, the second body 12 covers the first body 11 from above. The horizontal state is similar to that of the image forming apparatus 1 of the first embodiment shown in FIG. 1.

As shown in FIG. 3, the second body 12 pivots around the pivot axis X2 such that the rear end portion 12B is spaced upward apart from the first body 11. Thus, the second body 12 is inclined upward with respect to the first body 11, and the first opening 11A is released. As a result, the process cartridges 31 are exposed from the first body 11 via the first opening 11A. At this time, a space S2 is produced above the process cartridges 31. Thus, the process cartridges 31 can be easily attached to and removed from the first body 11 via the space S2. The transfer belt 50 and the photosensitive drums 40 do not interfere with attachment and removal of the process cartridges 31 because they move upward together with the second body 12.

Thus, even with the image forming apparatus 2 of the second embodiment, it is clear that effects similar to those brought about by the image forming apparatus 1 of the first embodiment can be appreciated.

The process cartridges 31 of the second embodiment are removable along arrowed vertical directions shown in FIG. 3. However, the process cartridges 31 may be removable diagonally upward to the rear.

A third embodiment will be described with reference to FIGS. 4-6.

Figure 4:
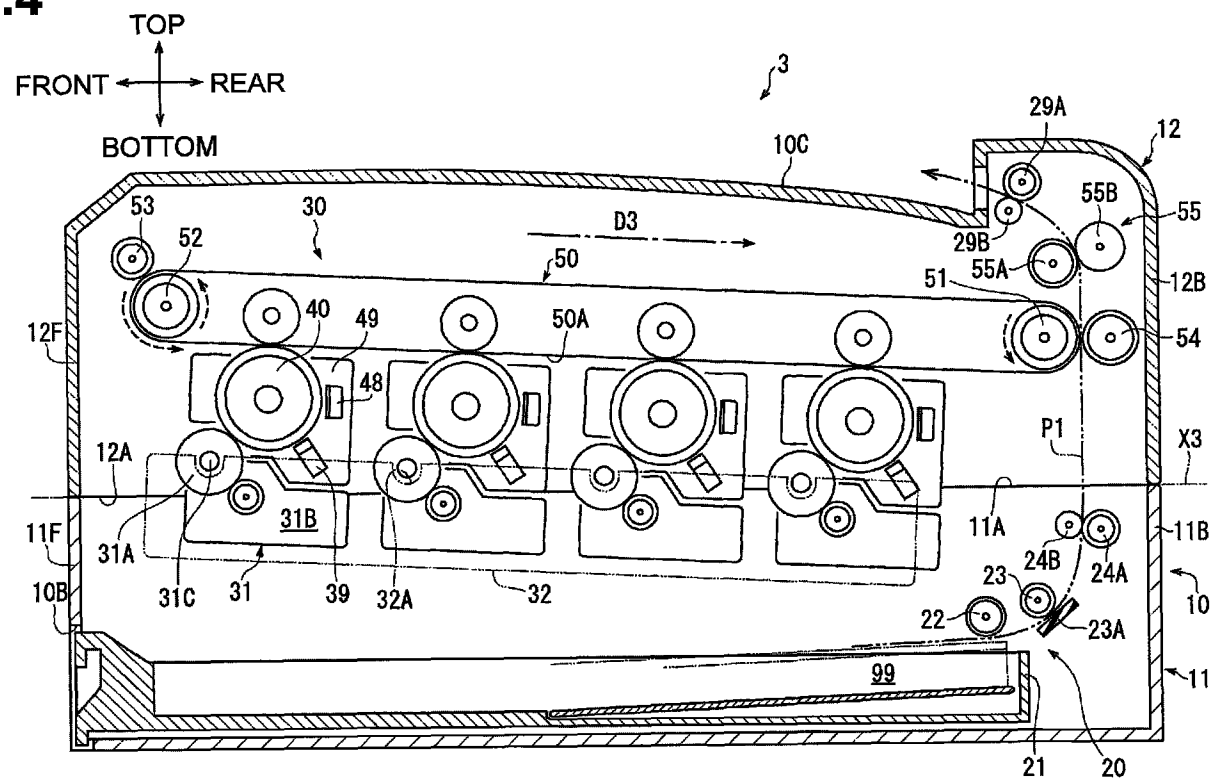
FIG. 4 is a cross sectional view schematically illustrating an image forming apparatus according to a third illustrative embodiment of the disclosure.
Figure 5:
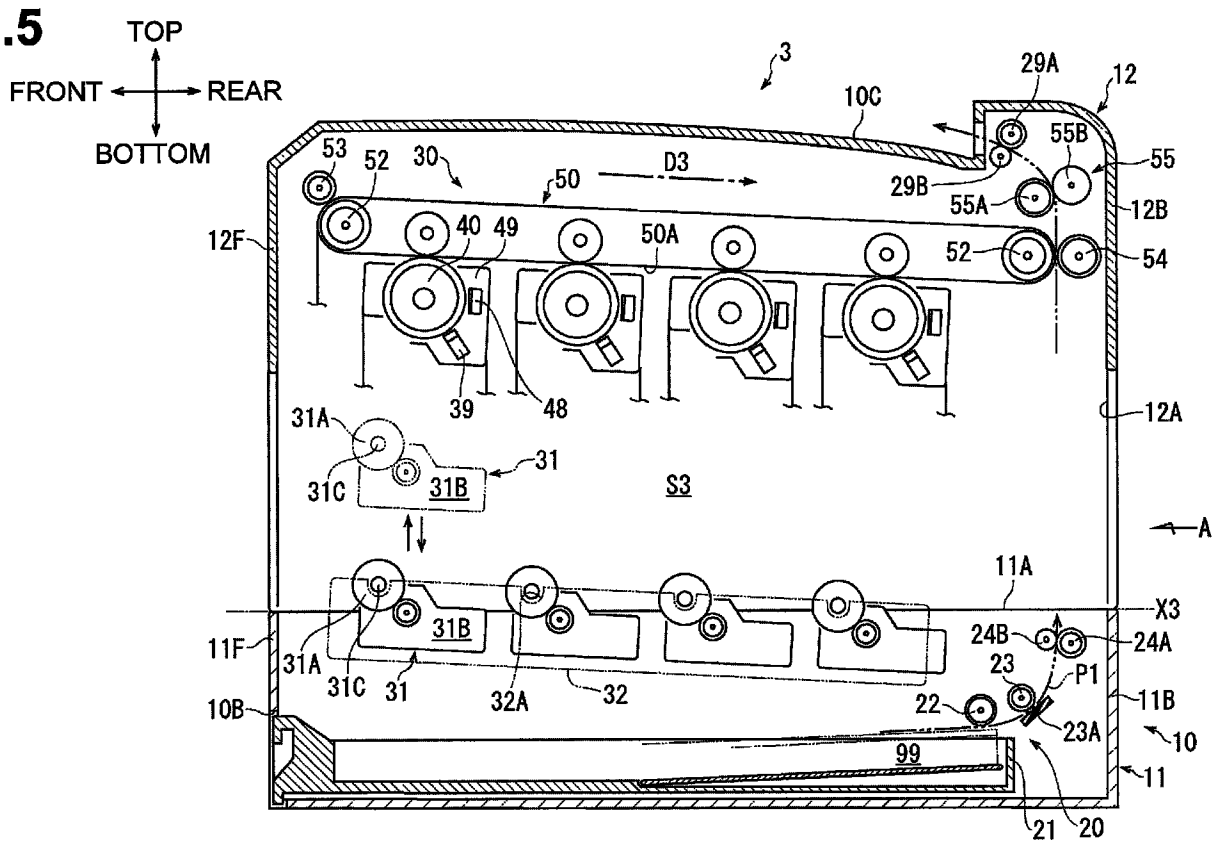
FIG. 5 is a cross sectional view schematically illustrating the image forming apparatus according to the third illustrative embodiment of the disclosure in which a second body pivots with respect to a first body.
Figure 6:
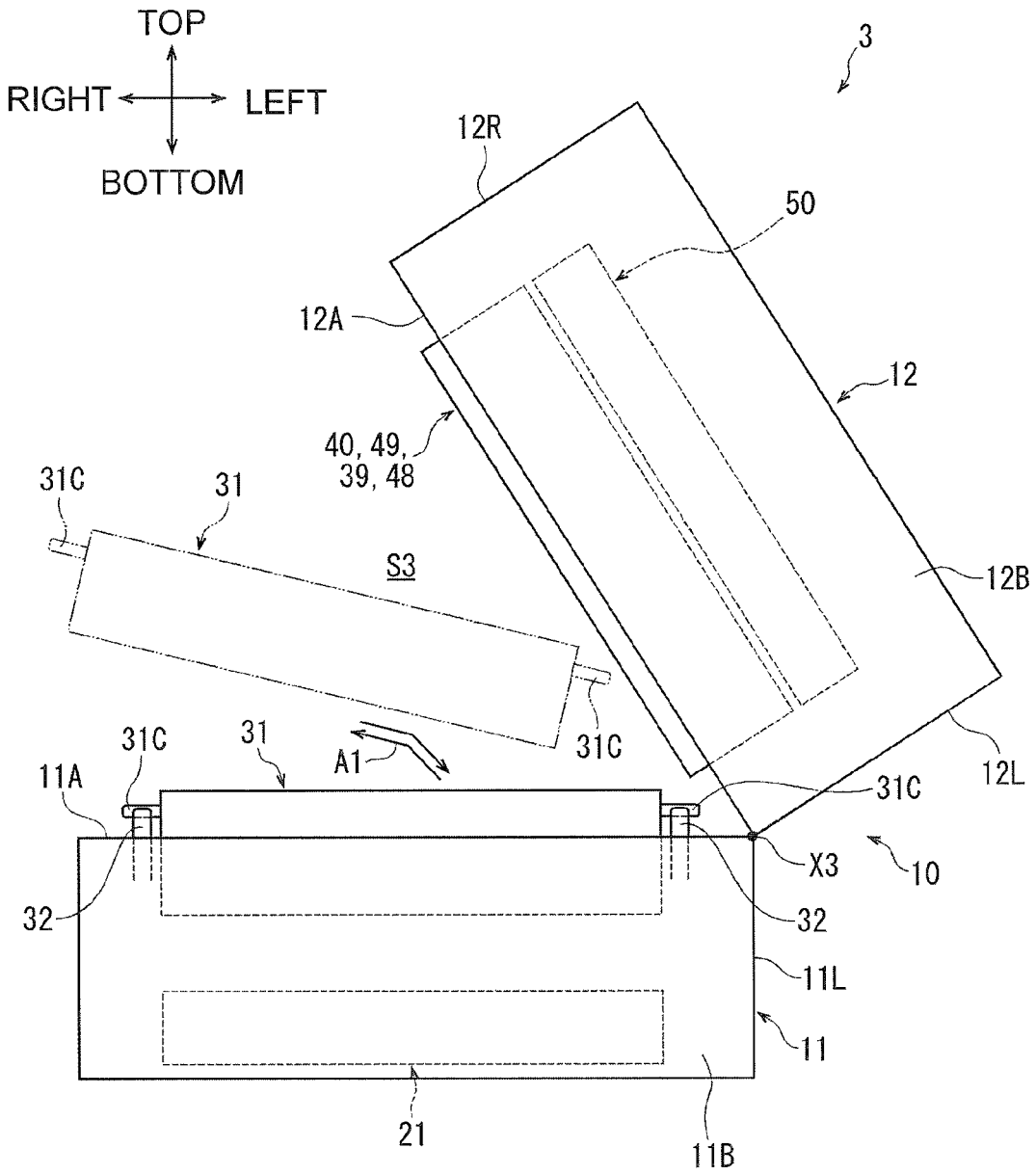
FIG. 6 is a rear side view of the image forming apparatus according to the third illustrative embodiment of the disclosure as viewed from an arrow direction A of FIG. 5.

As shown in FIGS. 4-6, an image forming apparatus 3 of the third embodiment is structured such that the transfer surface 50A of the image forming apparatus 1 of the first embodiment has been modified to be inclined downward to the rear. The image forming apparatus 3 of the third embodiment uses a pivot axis X3, whose position is changed from the pivot axis X1 of the image forming apparatus 1 of the first embodiment. Other elements of the image forming apparatus 3 of the third embodiment are similar to or identical with those of the image forming apparatus 1 of the first embodiment. Thus, it is noted that the elements are designated by similar numerals, and thus the description thereof can be omitted for the sake of brevity.

As shown in FIG. 4, the image forming apparatus 3 of the third embodiment is structured such that the driven roller 52 is located higher than the drive roller 51 relative to the horizontal line. Thus, the transfer surface 50A is inclined downward from the front side to the rear side. In FIG. 4, a direction D3 represents a longitudinal direction that is parallel to the transfer surface and perpendicular to the width direction of a sheet. As the transfer surface 50A is inclined, the photosensitive drums 40, the support members 49, the chargers 48, the exposure LEDs 39, the process cartridges 31, and the process cartridge support member 32 are inclined along the direction D3.

As shown in FIGS. 5 and 6, the second body 12 is supported by the first body 11 such that the second body 12 pivots around a pivot axis X3 located on a side closer to a left end portion 11L of the first body 11. The pivot axis X3 is located between an upper end of the left end portion 11L of the first body 11 and a lower end of a left end portion 12L of the second body 12, and extends substantially horizontally in the front-rear direction. The front-rear direction in which the pivot axis X3 extends is an example of a substantially horizontal direction perpendicular to the width direction of a sheet.

As shown in FIG. 4, the second body 12 covers the first body 11 from above when the second body 12 does not pivot around the pivot axis X3 or when the second body 12 is disposed in a substantially horizontal state.

As shown in FIGS. 5 and 6, the second body 12 pivots around the pivot axis X3 such that a right end portion 12R of the second body 12 is spaced upward apart from the first body 11. Thus, the second body 12 is inclined upward with respect to the first body 11, and the first opening 11A is released. As a result, the process cartridges 31 are exposed from the first body 11 via the first opening 11A. At this time, a space S3 is produced above the process cartridges 31. Thus, the process cartridges 31 can be easily attached to and removed from the first body 11 via the space S3. The transfer belt 50 and the photosensitive drums 40 do not interfere with attachment and removal of the process cartridges 31 because they move upward together with the second body 12.

Thus, even with the image forming apparatus 3 of the third embodiment, it is clear that effects similar to those brought about by the image forming apparatus 1 of the first embodiment and the image forming apparatus 2 of the second embodiment can be appreciated.

In the image forming apparatus 3, the pivot axis X3 extends in substantially a horizontal direction perpendicular to the width direction of the sheet 99, or in the front-rear direction. With this structure, the space S3 is provided equally above all of the four process cartridges 31 arranged along the longitudinal direction D3. Thus, as shown by an arrow direction A1 of FIG. 6, each process cartridge 31 can be easily removed from the first body 11 by raising the right end of the process cartridge 31 and then pulling the process cartridge 31 diagonally upward. By reversing the above removal procedure, each process cartridge 31 can be easily attached to the first body 11.

A fourth embodiment will be described with reference to FIGS. 7 and 8.

Figure 7:
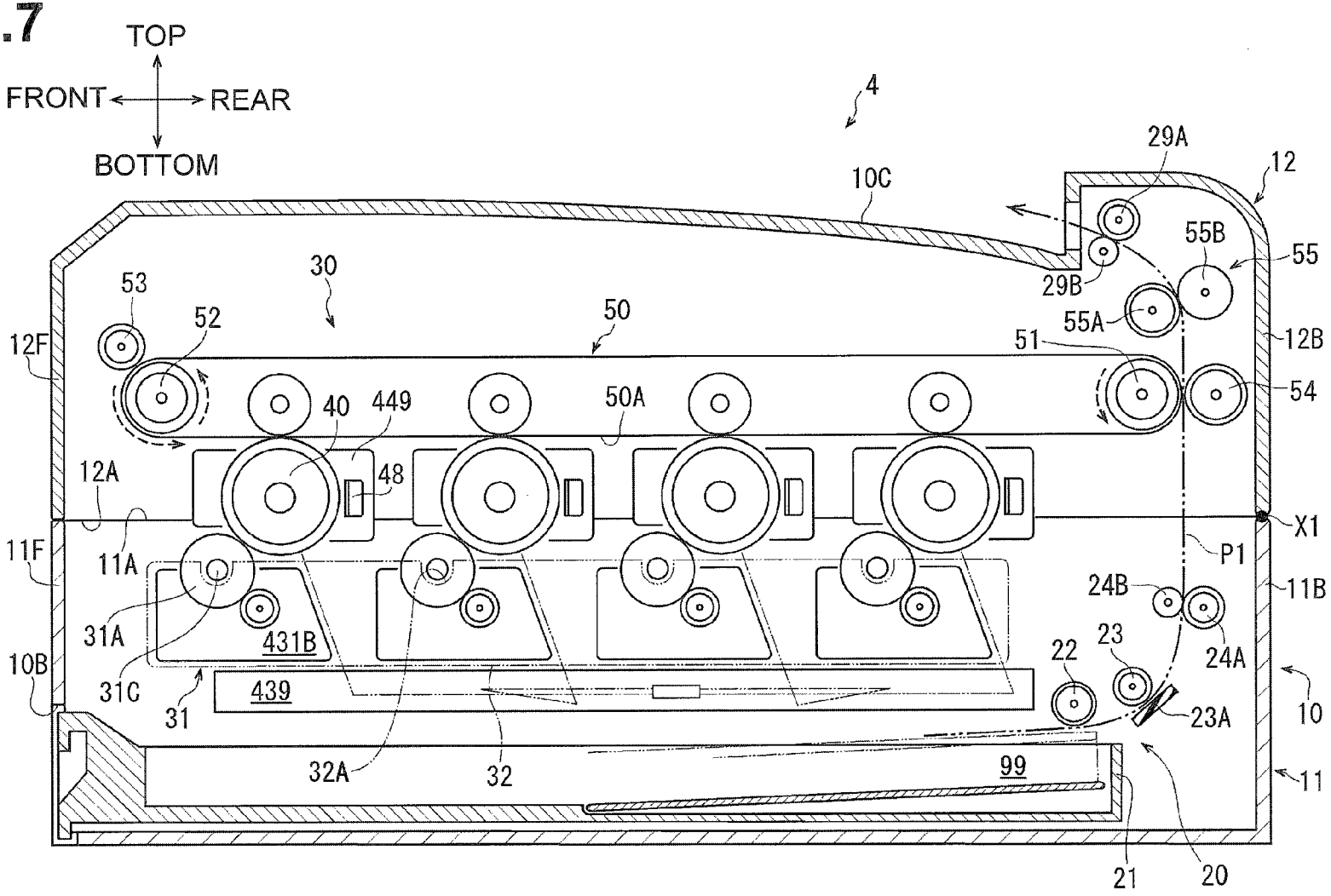
FIG. 7 is a cross sectional view schematically illustrating an image forming apparatus according to a fourth illustrative embodiment of the disclosure.
Figure 8:
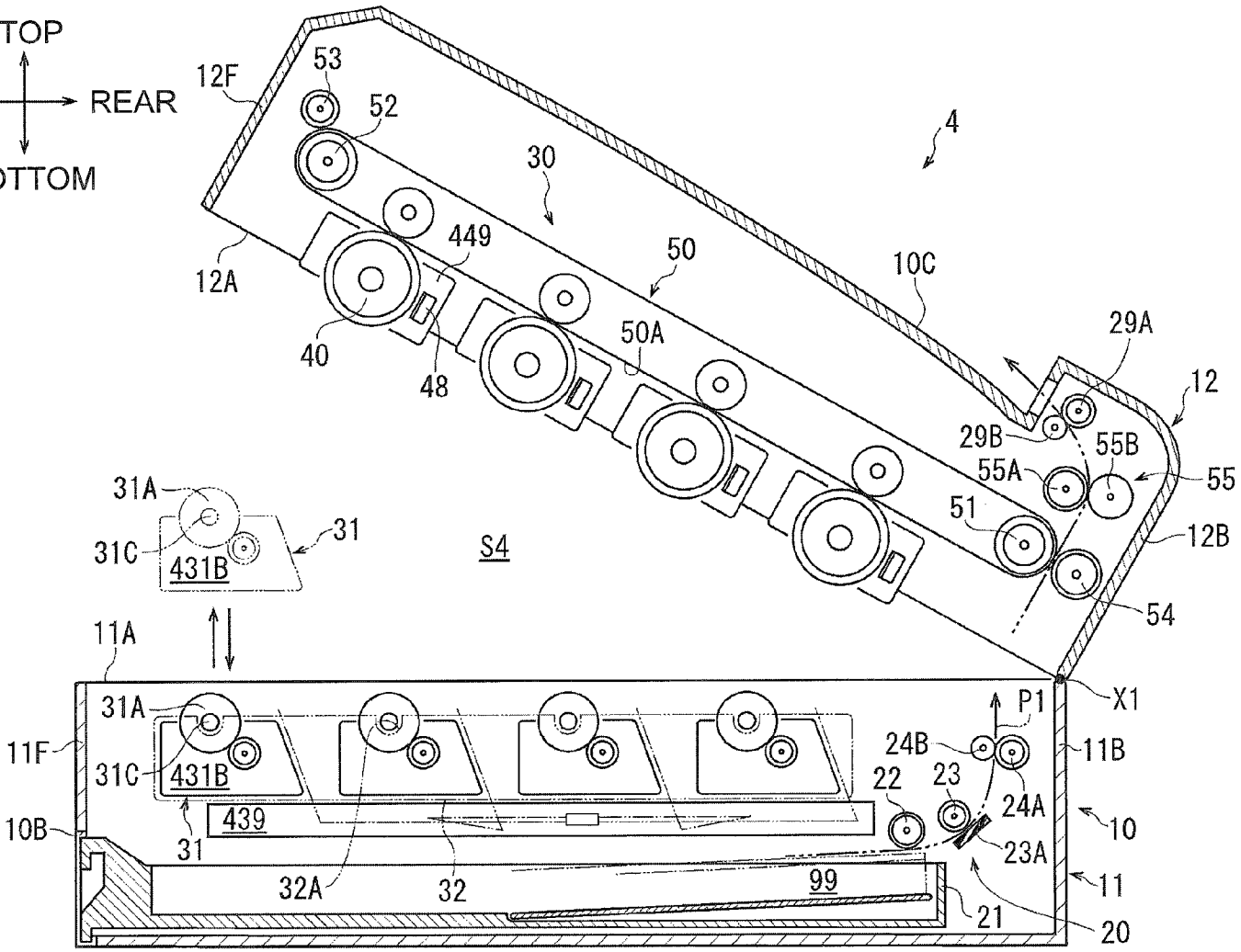
FIG. 8 is a cross sectional view schematically illustrating the image forming apparatus according to the fourth illustrative embodiment of the disclosure in which a second body pivots with respect to a first body.

As shown in FIGS. 7 and 8, an image forming apparatus 4 of the fourth embodiment uses a scanner 439 instead of the exposure LEDs 39 of the image forming apparatus 1 of the first embodiment. Thus, the image forming apparatus 4 uses support members 449 and toner containers 431B which are modified from the support members 49 and the toner container 31B of the image forming apparatus 1 of the first embodiment. Other elements of the image forming apparatus 4 of the fourth embodiment are similar to or identical with those of the image forming apparatus 1 of the first embodiment. Thus, it is noted that the elements are designated by similar numerals, and thus the description thereof can be omitted for the sake of brevity.

As shown in FIG. 7, the scanner 439 is accommodated in the first body 11 in the image forming apparatus 4 of the fourth embodiment. The scanner 439 is located below the process cartridges 31 and above the sheet cassette 21. The scanner 439 is assembled to a frame member, not shown, disposed in the first body 11.

The scanner 439 includes a laser light source, a polygon mirror, an fθ lens, and a reflection mirror, and is configured to irradiate each photosensitive drum 40 with laser beam from below and form an electrostatic latent image on each photosensitive drum 40.

As each support member 449 does not contain the exposure LED 39, it is void of a portion of the support member 49 of the first embodiment that is located at the rear of and diagonally downward from the corresponding photosensitive drum 40. Thus, each support member 449 is structured not to interrupt with the laser beam with which the scanner portion 439 irradiates the corresponding photosensitive drum 40. Other elements of the support member 449 are similar to those of the support member 49 of the first embodiment.

In comparison with the toner container 31B of the first embodiment, a toner container 431B is shifted frontward such that it does not interfere with the laser beam with which the scanner portion 439 irradiates the corresponding photosensitive drum 40. Other elements of the toner container 431B are similar to those of the toner container 31B of the first embodiment.

In the image forming apparatus 4, as shown in FIG. 8, the second body 12 pivots around the pivot axis X1 such that the front end portion 12F is spaced upward apart from the first body 11. Thus, when the second body 12 is inclined upward with respect to the first body 11, the driven roller 52, the photosensitive drums 40, the support members 449, and the chargers 38 move integrally with the second body 12, and are spaced upward apart from the first body 11. With this state, each process cartridge 31 can be easily attached to and removed from the first body 11 via a space S4. In addition, the scanner portion 439 located below the process cartridges 31 in the first body 11, the transfer belt 50, the photosensitive drums 40, and the support members 49 spaced upward apart from the first body 11 along with the second body 12 do not interfere with attachment or removal of each process cartridge 31.

Thus, even with the image forming apparatus 4 of the fourth embodiment, it is clear that effects similar to those brought about by the image forming apparatuses 1 to 3 of the first to third embodiments can be appreciated.

The process cartridges 31 of the fourth embodiment are removable along arrowed vertical directions shown in FIG. 8. The process cartridges 31 may be removable diagonally upward to the front.

Figure 9:
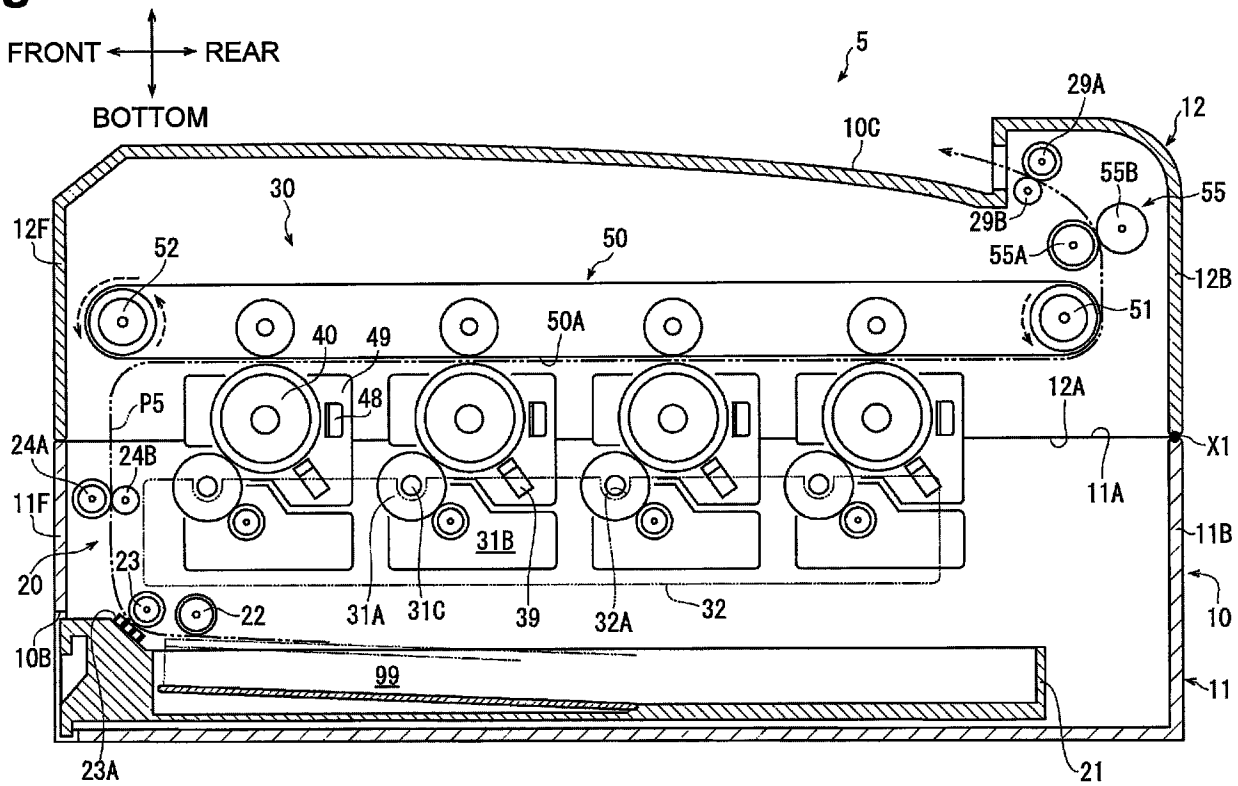
FIG. 9 is a cross sectional view schematically illustrating an image forming apparatus according to a fifth illustrative embodiment of the disclosure.

A fifth embodiment will be described with reference to FIG. 9.

The image forming apparatuses 1 to 4 of the first to fourth embodiments are configured to form an image by intermediate transfer method. As shown in FIG. 9, an image forming apparatus 5 of the fifth embodiment is configured to form an image by direct transfer method. The image forming apparatus 5 uses a sheet convey path P5 instead of the sheet convey path P1 of the image forming apparatus 1 of the first embodiment. Thus, in the image forming apparatus 5, the position of the sheet supply portion 20 is changed from that of the image forming apparatus 1 of the first embodiment and the second transfer roller 54 is omitted. Other elements of the image forming apparatus 5 of the fifth embodiment are similar to or identical with those of the image forming apparatus 1 of the first embodiment. Thus, it is noted that the elements are designated by similar numerals, and thus the description thereof can be omitted for the sake of brevity.

In the image forming apparatus 5 of the fifth embodiment, the sheet convey path P5 goes from the front end portion of the sheet cassette 21 to the front end portion 11F of the first body 11, and changes its route upward. The sheet convey path P5 then goes substantially vertically upward along the front end portion 11F of the first body 11 and the front end portion 12F of the second body 12. The sheet convey path P5 then changes its route rearward immediately below the transfer surface 50A, and goes rearward between the transfer surface 50A, which is substantially horizontal, and the photosensitive drums 40. Then, the sheet convey path P5 changes its route frontward in an upper portion of the front end portion 12B of the second body 12 and leads to the ejection tray 10C.

In the fifth embodiment, the sheet supply portion 20 is disposed on a side closer to the front end portion of the sheet cassette 21. The pickup roller 22, the separation roller 23, the separation pad 23A, and a pair of conveying rollers 24A, 24B are disposed along the sheet convey path P5.

The sheet supply portion 20 is configured to singly convey a sheet 99 from the sheet cassette 21 along the sheet convey path P5 to the transfer surface 50A. The sheet 99 conveyed to the transfer surface 50A is conveyed to the rear along substantially a horizontal portion of the sheet convey path P5 while being held on the transfer surface 50A. At this time, each photosensitive drum 40 rotates while in contact with the sheet 99, such that a toner image formed on the surface of each photosensitive drum 40 is transferred onto the sheet 99. The sheet 99 is conveyed to the fixing unit 55 such that the toner image is fixed, and then is ejected to the ejection tray 10C by the ejection rollers 29A, 29B. In this manner, the image forming apparatus 5 forms an image on a sheet 99 by direct transfer method.

Although not shown, the image forming apparatus 5 is structured such that the second body 12 pivots around the pivot axis X1 to release the opening 11A as in the case of the image forming apparatus 1 of the first embodiment shown in FIG. 2. Thus, the transfer belt 50 and the photosensitive drums 40 accommodated in the second body 12 move integrally with the second body 12, and are spaced upward apart from the process cartridges 31. The process cartridges 31 can be removed and attached in a similar manner to that of the image forming apparatus 1 of the first illustrative embodiment.

Thus, even with the image forming apparatus 5 of the fifth embodiment, it is clear that effects similar to those brought about by the image forming apparatuses 1 to 4 of the first to fourth embodiments can be appreciated.

A sixth embodiment will be described with reference to FIG. 10.

Figure 10:
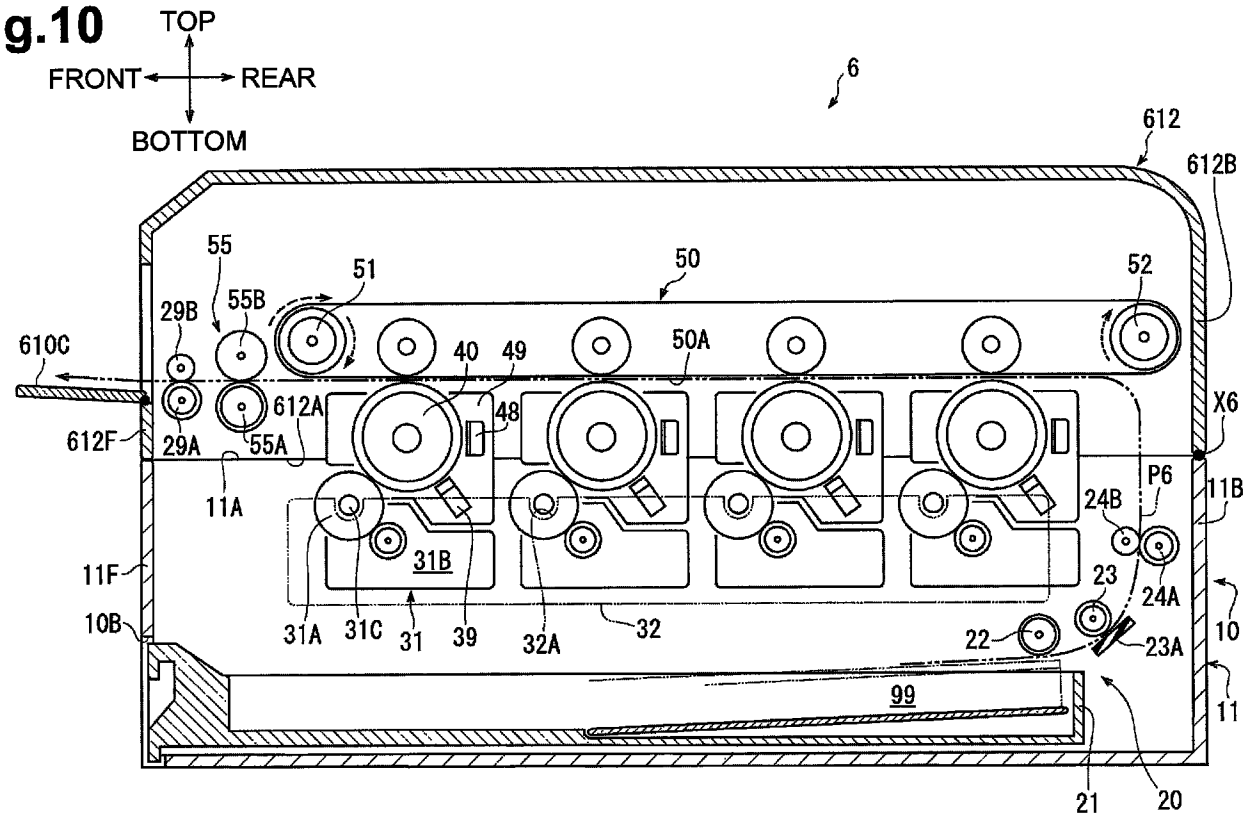
FIG. 10 is a cross sectional view schematically illustrating an image forming apparatus according to a sixth illustrative embodiment of the disclosure.

As shown in FIG. 10, an image forming apparatus 6 of the sixth embodiment is configured to form an image by direct transfer method as in the case of the image forming apparatus 5 of the fifth embodiment. The image forming apparatus 6 of the sixth embodiment uses a sheet convey path P6 and a second body 612 instead of the sheet convey path P1 and the second body 12 of the image forming apparatus 1 of the first embodiment. In the image forming apparatus 6, the secondary transfer roller 54 is omitted, and the positions of the fixing unit 55 and the ejection rollers 29A, 29B and the rotation direction of the transfer belt 50 are changed from those of the image forming apparatus 1 of the first embodiment. Other elements of the image forming apparatus 6 of the sixth embodiment are similar to or identical with those of the image forming apparatus 1 of the first embodiment. Thus, it is noted that the elements are designated by similar numerals, and thus the description thereof can be omitted for the sake of brevity.

In the image forming apparatus 6 of the sixth embodiment, the second body 612 includes an openable ejection tray 610C instead of the ejection tray 10C of the second body 12 of the first embodiment. As shown in FIG. 10, when the ejection tray 610C extends frontward from a front end portion 612F substantially horizontally, the ejection tray 610C is configured to receive a sheet 99 ejected on a surface facing upward.

The second body 612 is supported by the first body 11 such that the second body 612 pivots around a pivot axis X6 located on a side closer to the rear end portion 11B of the first body 11. The pivot axis X6 is located between the upper end of the rear end portion 11B of the first body 11 and a lower end of the rear end portion 612 of the second body 612, and extends in the left-right direction.

The sheet convey path P6 goes from the rear end portion of the sheet cassette 21 toward the rear end portion 11B of the first body 11, and changes its route upward. The sheet convey path P6 then goes substantially vertically upward along the rear end portion 11B of the first body 11 and the rear end portion 612B of the second body 612. The sheet convey path P6 then changes its route frontward immediately below the transfer surface 50A, goes frontward between the transfer surface 50A, which is substantially horizontal, and the photosensitive drums 40, and leads to the ejection tray 610C.

The fixing unit 55 is located on a downstream side from the transfer surface 50A in substantially a horizontal portion of the sheet convey path P6. The ejection rollers 29A, 29B are located on a downstream side from the fixing unit 55 in substantially the horizontal portion of the sheet covey path P6, and adjoin the ejection tray 610C.

In the sixth embodiment, the drive roller 51 is disposed on a side closer to the front end portion 612F of the second body 612, and the driven roller 52 is disposed on a side closer to the rear end portion 612B of the second body 612. The rotation directions of the drive roller 51, the driven roller 52, and the transfer belt 50 are clockwise direction in FIG. 10.

The sheet supply portion 20 is configured to singly convey a sheet 99 from the sheet cassette 21 along the sheet convey path P6 to the transfer surface 50A. The sheet 99 conveyed to the transfer surface 50A is conveyed to the front side along substantially the horizontal portion of the sheet convey path P6 while being held on the transfer surface 50A. At this time, each photosensitive drum 40 rotates while in contact with the sheet 99, such that a toner image formed on the surface of each photosensitive drum 40 is transferred onto the sheet 99. The sheet 99 is conveyed to the fixing unit 55 such that the toner image is fixed, and then is ejected to the ejection tray 610C by the ejection rollers 29A, 29B. In this manner, the image forming apparatus 6 forms an image on a sheet 99 by direct transfer method.

The second body 612 covers the first body 11 from above when the second body 612 is not pivoting around the pivot axis X6 or it is disposed substantially horizontally. With this state, the first opening 11A and a second opening 612A overlap vertically.

Although not shown, the image forming apparatus 6 is structured such that the second body 612 pivots around the pivot axis X6 to release the opening 11A as in the case of the image forming apparatus 1 of the first embodiment shown in FIG. 2. Thus, the transfer belt 50 and the photosensitive drums 40 accommodated in the second body 612 move integrally with the second body 612, and are spaced upward apart from the process cartridges 31. The process cartridges 31 can be removed and attached in a similar manner to that of the image forming apparatus 1 of the first illustrative embodiment.

Thus, even with the image forming apparatus 6 of the sixth embodiment, it is clear that effects similar to those brought about by the image forming apparatuses 1 to 5 of the first to fifth embodiments can be appreciated.

A seventh embodiment will be described with reference to FIGS. 11 and 12.

Figure 11:
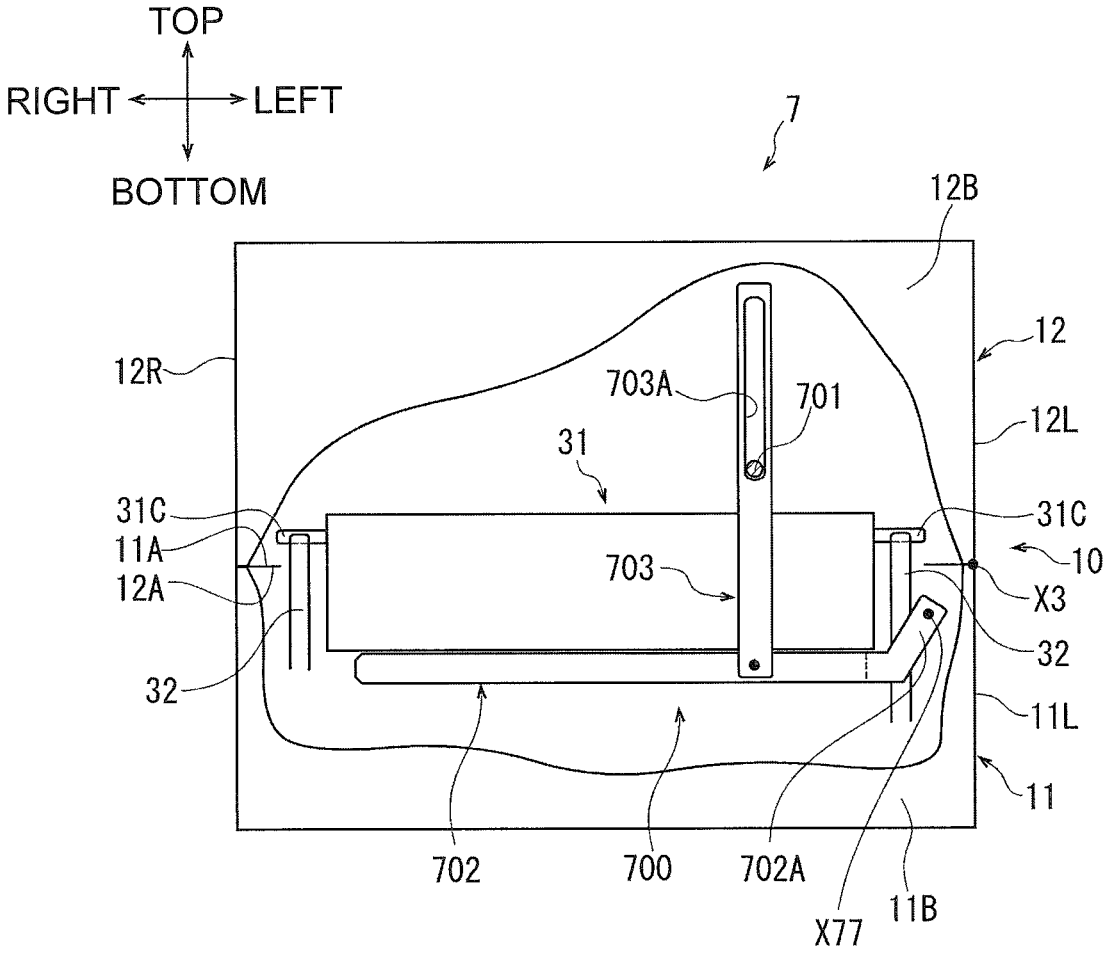
FIG. 11 schematically illustrates a developing unit, a process cartridge supporting member and a link mechanism excerpted from an image forming apparatus according to a seventh illustrative embodiment of the disclosure as viewed from a direction similar to the arrow direction A of FIG. 5, in which a second body is not pivoting with respect to a first body.
Figure 12:
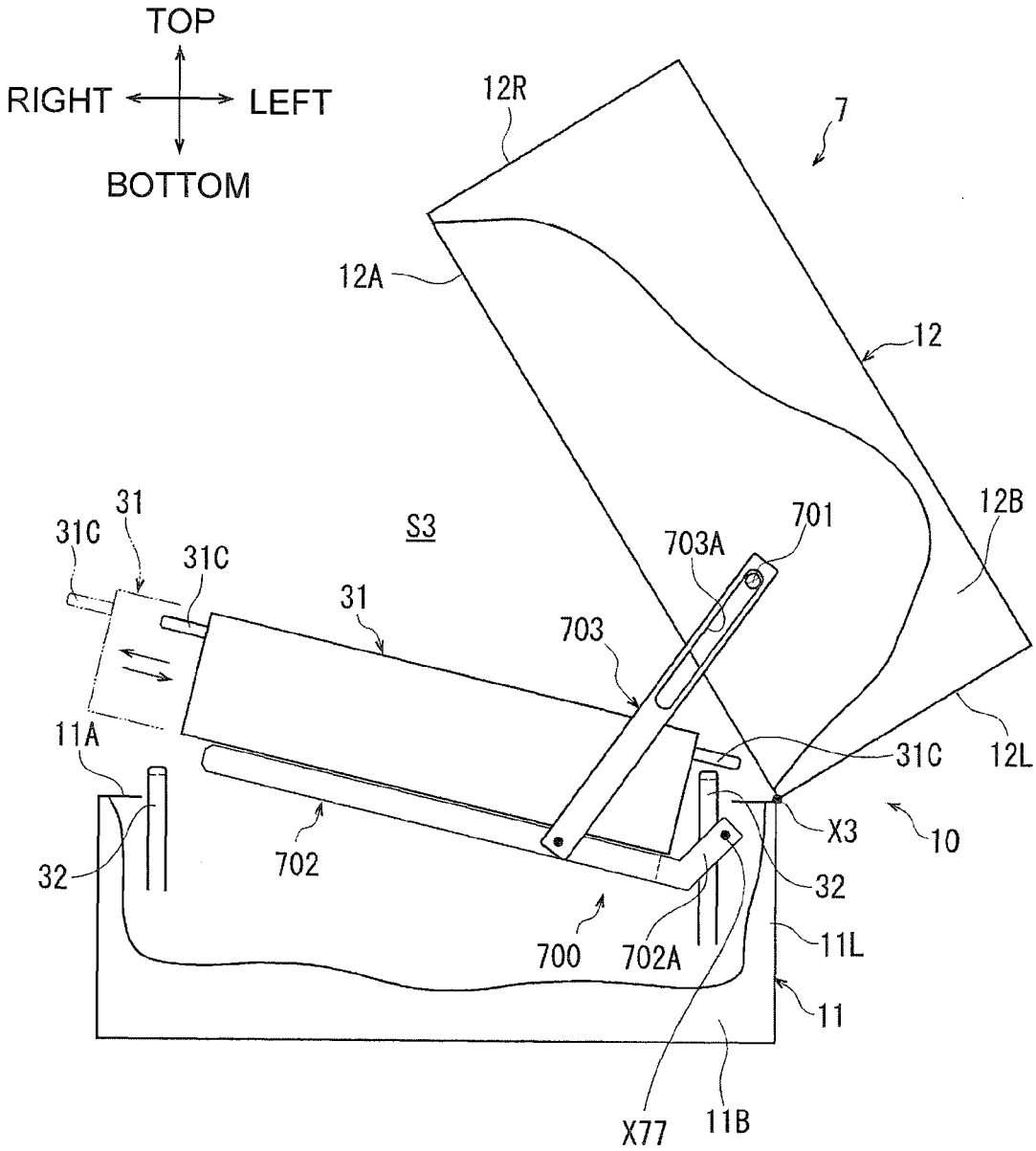
FIG. 12 schematically illustrates the developing unit, the process cartridge supporting member and the link mechanism excerpted from the image forming apparatus according to the seventh illustrative embodiment of the disclosure as viewed from the direction similar to the arrow direction A of FIG. 5, in which the second body is pivoting with respect to the first body.

As shown in FIGS. 11 and 12, an image forming apparatus 7 of the seventh embodiment further includes a link mechanism 700 in addition to the elements of the image forming apparatus 3 of the third embodiment. Other elements of the image forming apparatus 7 of the seventh embodiment are similar to or identical with those of the image forming apparatus 3 of the third embodiment. Thus, it is noted that the elements are designated by similar numerals, and thus the description thereof can be omitted for the sake of brevity. In FIGS. 11 and 12, elements except for the process cartridges 31, the process cartridge support member 32, and the link mechanism 700 are omitted.

As shown in FIG. 11, in the image forming apparatus 7 of the seventh embodiment, the link mechanism 700 includes an input portion 701 disposed in the second body 12, a lift-up portion 702 disposed in the first body 11, and a transmission portion 703 coupling the input portion 701 and the lift-up portion 702.

The input portion 701 is a cylindrical shaft extending shortly in the front-rear direction, and is fixed to the frame member, not shown, disposed in the second body 12.

The lift-up portion 702 is disposed below each process cartridge 31 and has a shape of substantially a flat plate extending in the front-rear direction. The lift-up portion 702 is sandwiched between the left and right plates of the process cartridge support member 32.

The lift-up portion 702 includes a front arm portion 702A and a rear arm portion 702A, which are located in corners of, closer to the pivot axis X3, front and rear edges of the lift-up portion 702. The arm portions 702A protrude diagonally upward to the left so as to be closer to the pivot axis X3. FIG. 11 shows only the rear arm portion 702A located at the rear edge of the lift-up portion 702. Although not shown, the front arm portion 702A located at the front edge of the lift-up portion 702 has an identical shape.

The front and rear arm portions 702A of the lift-up portion 702 are rotatably supported by the frame member (not shown) disposed in the first body 11, such that the front and rear arm portions 702A pivot around a pivot axis X77 parallel to the pivot axis X3.

The transmission portion 703 is a bar extending vertically. A lower side of the transmission portion 703 is connected to the lift up portion 702. An upper side of the transmission portion 703 has a long hole 703A elongated vertically. The input portion 701 is inserted into the transmission portion 703 below the long hole 703A.

In the image forming apparatus 7 of the seventh embodiment, as shown in FIG. 12, when the second body 12 pivots around the pivot axis X3, a large space S3 is produced above each process cartridge 31. At this time, a space above a right side of each process cartridge 31 apart from the pivot axis X3 is larger than a space above a left side of the process cartridge 31 close to the pivot axis X3.

The link mechanism 700 moves as follows in response to the pivoting of the second body 12. The input portion 701 pivots around the pivot axis X3 together with the second body 12 from the position shown in FIG. 11 and moves upward and leftward as shown in FIG. 12. At this time, the input portion 701 slides in the long hole 703A of the transmission portion 703 from the bottom to the top, and then contacts an upper end portion of the long hole 703A and raises the transmission portion 703. Movement of the transmission portion 703 is transmitted to the lift-up portion 702, and the lift-up portion 702 pivots upward around the pivot axis X77. Thus, the lift-up portion 702 is inclined upward to the right, and the right side of each process cartridge 31 apart from the pivot axis X3 is spaced upward apart from the first body 11. In this manner, the link mechanism 700 allows the right side of each process cartridge 31, which is distant from the pivot axis X3, to move to the large space S3. As a result, each process cartridge 31 can be easily removed from the first body 11 only by pulling each inclined process cartridge 31 diagonally upward to the front so as to separate from the pivot axis X3. By reversing the above step, each process cartridge 31 can be easily attached to the first body 11. As a result, the image forming apparatus 7 facilitates replacement of the process cartridges 31 more easily.

The first embodiment shows, but is not limited to, that the charger 48 and the exposure LED 39 are assembled in the support member 49. At least one of the charger 48 and the exposure LED 39 may be assembled in the process cartridge 31.

The first embodiment shows, but is not limited to, that the process cartridges 31 are removable along the arrowed vertical directions shown in, for example, FIG. 2. The process cartridges 31 may be removable diagonally upward.

In the image portion 30, the transfer belt 50, the drive roller 51, and the driven roller 52 constitute a transfer unit, e.g., a belt unit. Unless otherwise described herein, the term "transfer unit" is intended to cover both belt units that convey sheets and belt units that convey toner images to sheets.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. An image forming apparatus comprising:

a housing defining a sheet conveying path through which a sheet is conveyed;

a transfer belt disposed in the sheet conveying path within the housing, the transfer belt being configured to circulate and having a transfer surface which is a flat surface extending in a width direction of the sheet to be conveyed;

a plurality of photosensitive members disposed in the housing and facing the transfer surface from below, the plurality of photosensitive members being arranged in parallel relative to each other in a longitudinal direction of the transfer surface, the longitudinal direction of the transfer surface being parallel to the transfer surface and perpendicular to the width direction; and a plurality of developing units disposed in the housing such that each of the plurality of developing units corresponds to a corresponding one of the plurality of photosensitive members, each of the plurality of developing units being configured to supply a developer to an electrostatic latent image formed on a surface of the corresponding one of the plurality of photosensitive members and to develop the electrostatic latent image into a developer image, wherein the housing includes a first body configured to accommodate the plurality of developing units detachably and a second body disposed above the first body and configured to accommodate the transfer belt and the plurality of photosensitive members, wherein the second body is configured to pivot around a pivot axis located on a first end of the first body and to separate upwardly from the first body such that the plurality of developing units are exposed from the first body, and wherein the second body includes a plurality of exposure light emitting diodes (LEDs), each of the plurality of exposure LEDs for forming the electrostatic latent image on the surface of a corresponding one of the plurality of photosensitive members.

2. The image forming apparatus according to claim 1, wherein each of the plurality of developing units includes a developer container configured to store the developer and a developing roller configured to transport the developer stored in the developer container to the corresponding one of the plurality of photosensitive members.

3. The image forming apparatus according to claim 1, wherein the pivot axis extends in a substantially horizontal direction perpendicular to the width direction of the sheet.

4. The image forming apparatus according to claim 1, wherein the pivot axis extends in the width direction of the sheet, and wherein the sheet having an image thereon is conveyed from the first end of the first body to a second end of the first body opposite to the first end thereof, and ejected to an ejection tray disposed in the second body.

5. An image forming apparatus comprising:

a housing defining a sheet conveying path through which a sheet is conveyed, wherein the housing includes a first body and a second body disposed above the first body, the second body being configured to pivot around a pivot axis located on a first end of the first body, wherein the pivot axis extends in a substantially horizontal direction perpendicular to a width direction of the sheet;

a transfer belt disposed in the sheet conveying path within the housing, the transfer belt being configured to circulate and having a transfer surface which is a flat surface extending in the width direction of the sheet to be conveyed;

a plurality of photosensitive members disposed in the housing and facing the transfer surface from below, the plurality of photosensitive members being arranged in parallel relative to each other in a longitudinal direction of the transfer surface, the longitudinal direction of the transfer surface being parallel to the transfer surface and perpendicular to the width direction;

a plurality of developing units disposed in the housing such that each of the plurality of developing units corresponds to a corresponding one of the plurality of photosensitive members, each of the plurality of developing units being configured to supply a developer to an electrostatic latent image formed on a surface of the corresponding one of the plurality of photosensitive members and to develop the electrostatic latent image into a developer image; and a link mechanism configured to move an end of each of the plurality of developing units, which is remote from the pivot axis, upwardly apart from the first body, in response to pivoting of the second body around the pivot axis, wherein the first body is configured to accommodate the plurality of developing units detachably and the second body is configured to accommodate the transfer belt and the plurality of photosensitive members, and wherein the second body is configured to separate upwardly from the first body such that the plurality of developing units are exposed from the first body.

6. The image forming apparatus according to claim 5, wherein the first body includes a scanner for forming an electrostatic latent image on a surface of each of the plurality of photosensitive members.

7. An image forming apparatus comprising:

a housing defining a sheet conveying path through which a sheet is conveyed;

a plurality of developing units disposed in the housing, each of the plurality of developing units being configured to store developer therein;

a plurality of photosensitive members disposed in the housing such that each of the plurality of photosensitive members corresponds to a corresponding one of the plurality of developing units, each of the plurality of photosensitive members being configured to carry thereon a developer image developed with the developer supplied from the corresponding one of the plurality of developing units; and a transfer unit configured to transfer the developer image from each of the plurality of photosensitive members to the sheet conveyed along the sheet convey path, wherein the housing includes a first body configured to accommodate the plurality of developing units detachably and a second body configured to accommodate the transfer unit and the plurality of photosensitive members, wherein the second body is configured to move between an open position in which each of the plurality of developing units is exposed outside and a closed position in which each of the plurality of developing units is not exposed outside, and wherein the second body includes a plurality of exposure light emitting diodes (LEDs), each of the plurality of exposure LEDs for forming the developer image on a surface of the corresponding one of the plurality of photosensitive members.

8. The image forming apparatus according to claim 7, wherein the second body is configured to pivot around a pivot axis between the open position and the closed position.

9. The image forming apparatus according to claim 8, wherein the pivot axis extends in a direction parallel to a rotational axis of one of the plurality of photosensitive members.

10. The image forming apparatus according to claim 7, wherein the transfer unit includes a transfer belt.

11. The image forming apparatus according to claim 10, wherein the plurality of photosensitive members are disposed below the transfer belt.

12. The image forming apparatus according to claim 7, wherein each of the plurality of developing units is disposed below a corresponding one of the plurality of photosensitive members.

13. The image forming apparatus according to claim 7, wherein the second body of the housing is configured to separate upwardly from the first body.

* * * * *